US006115868A

United States Patent [19]

Tempongko

[11] Patent Number: 6,115,868

[45] Date of Patent: Sep. 12, 2000

[54] CLEANING DEVICE FOR PLANAR SURFACES

[76] Inventor: David Tempongko, 1136 Hidden Mist, Henderson, Nev. 89102

[21] Appl. No.: 09/256,559

[22] Filed: Feb. 24, 1999

[51] Int. Cl.[7] ..... A47L 1/02

[52] U.S. Cl. ..... 15/103; 15/98

[58] Field of Search ..... 15/50.1, 51, 98, 15/103

[56] References Cited

U.S. PATENT DOCUMENTS

| | | | |
|---|---|---|---|
| 3,080,592 | 3/1963 | Hassage | 15/103 |
| 4,137,591 | 2/1979 | Baker | 15/98 |
| 5,465,446 | 11/1995 | Chang | 15/103 |

*Primary Examiner*—Randall E. Chin
*Attorney, Agent, or Firm*—Robert Ryan Morishita Anderson & Morishita

[57] ABSTRACT

The present invention is a device and method for cleaning substantially planar surfaces such as glass-walled buildings. The device includes a boom and a guide structure pivotally connected to the boom to guide the boom in a forward and a reverse direction along the surface. Preferably, the guide structure is a plurality of skis. The guide structure is covered with mops which contact the surface. The boom is preferably moved in the forward and reverse directions along the surface by a tow line, a plurality of support lines, and a winch. The path of the boom is preferably guided by a pair of pulleys engaging a guide line anchored at the top and bottom of the surface. The method of the present invention includes providing the device of the present invention; rinsing the mops with water, preferably de-ionized water; defining a path along an uncleaned portion of the surface; towing the boom in the forward direction then in the reverse direction across the surface; and repeating the steps until the surface is cleaned.

6 Claims, 3 Drawing Sheets

50
54
52
46
11
10
56

CLEANING DEVICE FOR PLANAR SURFACES

FIELD OF THE INVENTION

The present invention pertains to methods and devices for cleaning large planar surfaces. Specifically, the present invention is a method and device for cleaning buildings with vertical, inclined or declined glass walls.

BACKGROUND OF THE INVENTION

Large planar surfaces, such as the walls of glass-walled buildings, are typically washed by workers in platforms suspended from the top of the building by an assembly of ropes and pulleys. The workers use a means, such as mops, to wet the surface and remove any dust or debris adhering to the surface. A squeegee is then passed over the surface to remove any excess water. The platform is then moved, typically downward, to an unwashed area of the building and the process is repeated.

This method has many drawbacks. First, it can be extremely unsafe for workers on the suspended platform. Also, the process is slow because the workers can only clean an area within reach of the platform at each platform location. Moreover, this method is not particularly well adapted for use on buildings with inclined or declined surfaces because the workers will likely have difficulty maintaining their balance on a tilted platform and the weight of the platform and the workers pressing on the surface may damage the surface.

It can be seen that there is a need in the art for a method and device for cleaning planar surfaces wherein the device is unmanned, can clean a large area in an expedient manner, and can be used for vertical, inclined, or declined surfaces.

SUMMARY OF THE INVENTION

The present invention is a device and method for cleaning substantially planar surfaces. The invention includes a guide structure pivotally connected to a boom. The guide structure guides the boom over obstructions and imperfections on the surface in both a forward and reverse direction while still maintaining contact with the surface. In a preferred embodiment, the guide structure comprises a plurality of skis. The skis are preferably arranged in a sawtooth arrangement across the boom by connecting the back end of each pair of skis to form a V-shape defining a fifteen degree angle. A plurality of mops covering the guide structure are in contact with the surface to be cleaned.

The boom is also connected to a means for towing the boom in the forward and reverse directions and a means for guiding the path of the boom as it is moves across the surface. Preferably, the towing means includes a plurality of support lines connected to the boom. A tow line is connected to the support lines. A winch is connected to the tow line to wind and unwind the tow line to thereby tow the boom in the forward and reverse directions.

A guiding means is provided to define the path of the cleaner as the towing means draws the cleaner in the forward and reverse directions. In a preferred embodiment, the guiding means is a pair of pulleys disposed on the boom and a guide line retained between said pulleys. The guide line is anchored at the top and bottom of said surface. Thus, as the boom is towed across the surface, the pulleys track the guide line and, thereby, guide the path of the boom.

In the method of the present invention, the device of the present invention is provided. The mops are rinsed with water. In a preferred embodiment, de-ionized water is used. The guiding means is used to define a path along an uncleaned portion of the surface and the towing means is used to tow the cleaner forward across the surface. The towing means is then used to move the cleaner in a reverse direction across the surface. The steps of rinsing, defining a path across an uncleaned portion, and towing the boom in a forward and reverse direction across the surface, are repeated until the surface is cleaned.

An object of the present invention is to provide an unmanned device for cleaning planar surfaces. Another object is to provide a cleaner which can glide over obstructions and imperfections in the surface without snagging but still maintain contact with the surface to insure proper cleaning. Yet another object of the invention is to provide a device which can clean a large surface area quickly. A further object of the invention is to provide a cleaner which can be used for inclined or declined surfaces as well as vertical surfaces. Also, it is an object of the present invention to provide a cleaner which can move in more than one angular direction. That is, a cleaner which can move along any line which can be defined along a vertical, inclined, or declined surface. Another object of the present invention is to provide a cleaner which does not need to be connected to a water supply or carry water reservoirs.

DESCRIPTION

Figure 1:
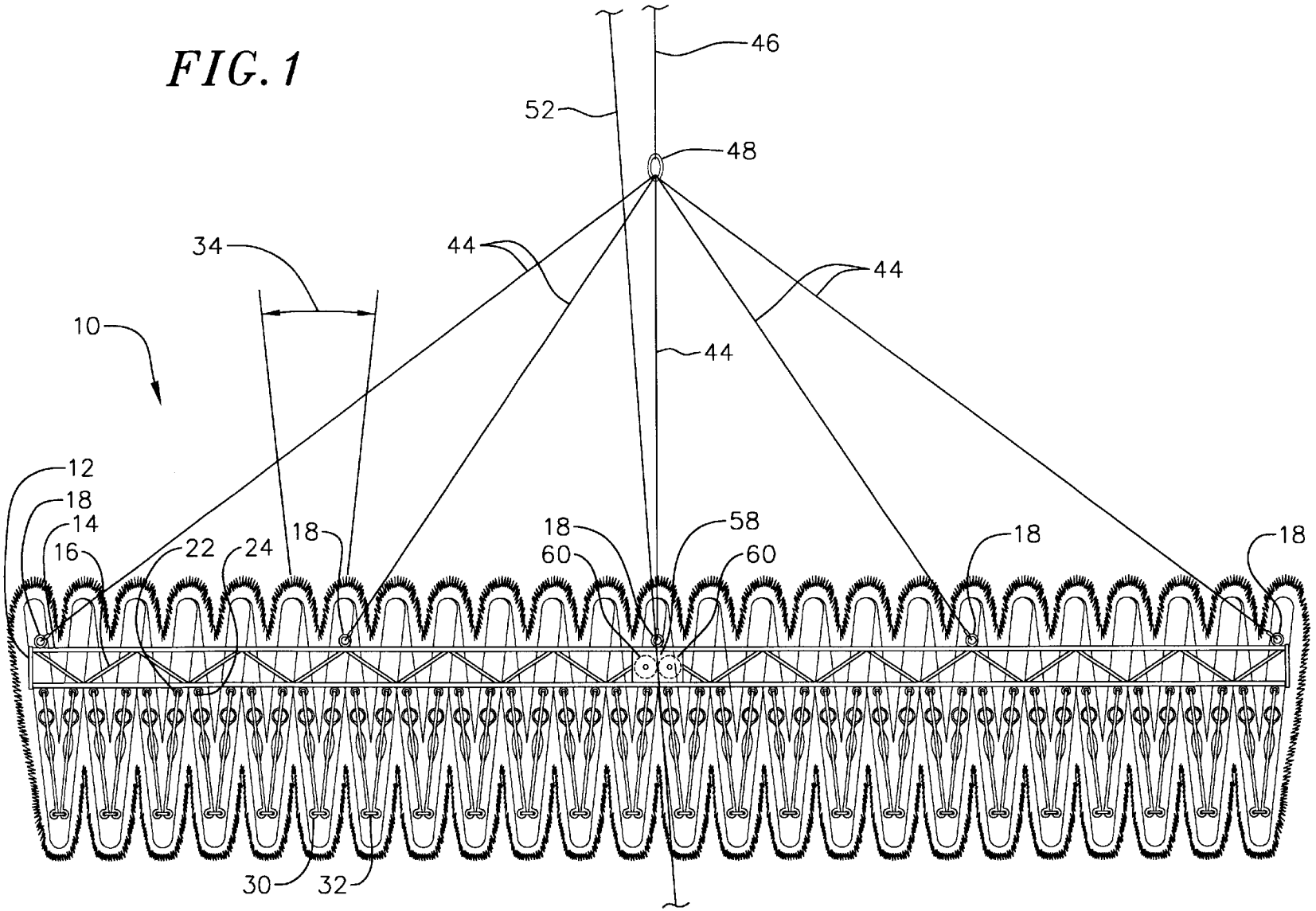
FIG. 1 is top view of the cleaner according to an embodiment of the present invention.

Reference is now made to the figures wherein like parts are referred to by like numerals throughout. Referring first to FIG. 1, the cleaner 10 includes a boom 12. The boom 12 is preferably formed of steel and includes two longitudinal members 14 connected by a plurality of cross members 16. In a preferred embodiment, the boom 12 is thirty feet in length and thirteen inches high. In a preferred embodiment, five eyelets 18 for connecting to support lines are connected to the top side of the boom 12.

Attached to the boom 12 is a guide structure which guides the boom 12 over obstructions and imperfections in the surface 11 as it is pulled in a forward or reverse direction along the surface 11 so that the cleaner 10 maintains contact with the surface 11. While the guide structure could include articulated wheels or a single pivotal ski, in the preferred embodiment, the guide structure comprises a plurality of skis 20. Each ski 20 is pivotally connected to one of a plurality of rings 22 on the boom 12 with a conventional spring clamp 24 known in the art. In the preferred embodiment, twenty five skis 20 are provided.

Figure 2:
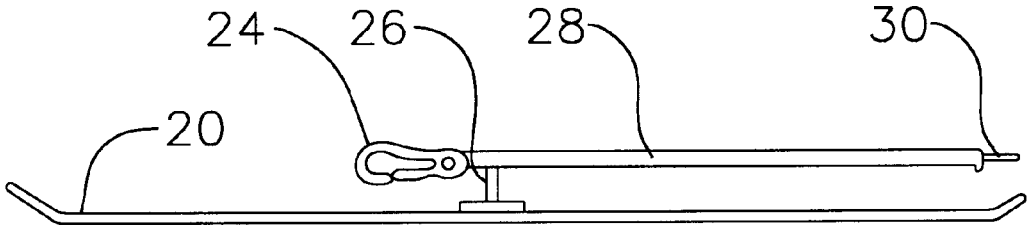
FIG. 2 is a side view of a ski of FIG. 1.
Figure 3:
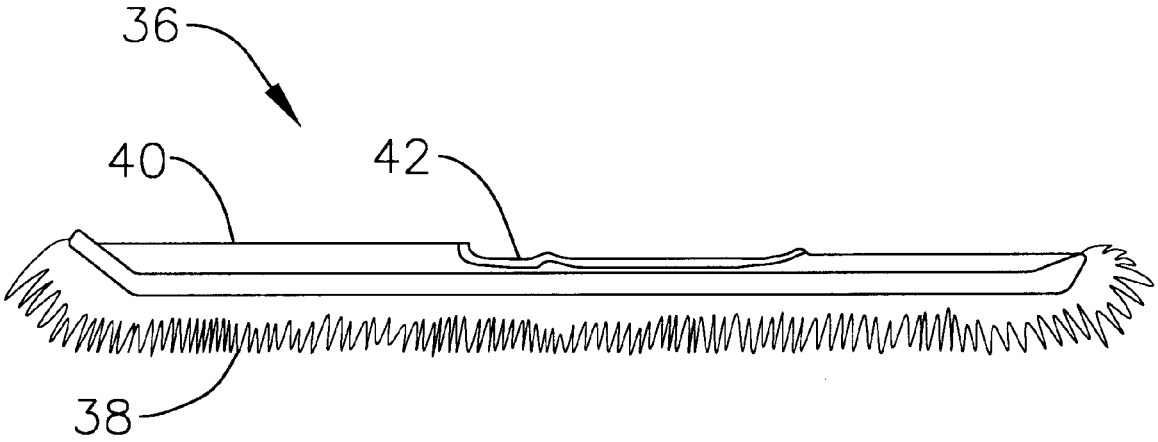
FIG. 3 is a side view of a mop of FIG. 1.

Referring to FIG. 2, each ski 20 is substantially flat with upturned ends. The upturned ends and pivotal connection between the spring clamp 24 and the ring 22 allow the skis 20 to easily travel over obstructions or imperfections on the surface 11 without catching or stubbing while maintaining contact with the surface 11.

A short post 26 connects each ski 20 to a connecting rod 28. Each connecting rod 28 has a conventional spring clamp 24 known in the art near the front of the ski 20 for connecting to a ring 22 on the boom 12. Each connecting rod 28 also has a loop 30 near the back of the ski. As shown in FIG. 1, the skis 20 are grouped into pairs, with the loops 30 of each pair of skis 20 being connected with links 32. Thus, each pair of skis 20 forms a V-shape and, consequently, the entire set of skis 20 forms a sawtooth shape across the boom 12. In a preferred embodiment, the angle 34 between each V-shaped pair of skis 20 is fifteen degrees. However, any angle 34 which allows the upper side of the sawtooth arrangement to collect dirt and debris while traveling in the forward direction without smearing or re-depositing the dirt and debris while traveling in the reverse direction will suffice.

Each ski 20 is covered with a mop 36 for scrubbing the dust and debris from the surface 11. The mop 36 has a cleaning surface 38 and a backing 40 containing a hole 42. The ski 20 rests between the cleaning surface 38 and the backing 40 with the post 26 protruding from the hole 42. The mops 36 are preferably formed of rayon, a rayon blend, or a like material which can trap dirt and debris during the cleaning process without smearing. More preferably, the mops 36 are made of a blended material with 65% rayon and 35% cotton.

Figure 4:
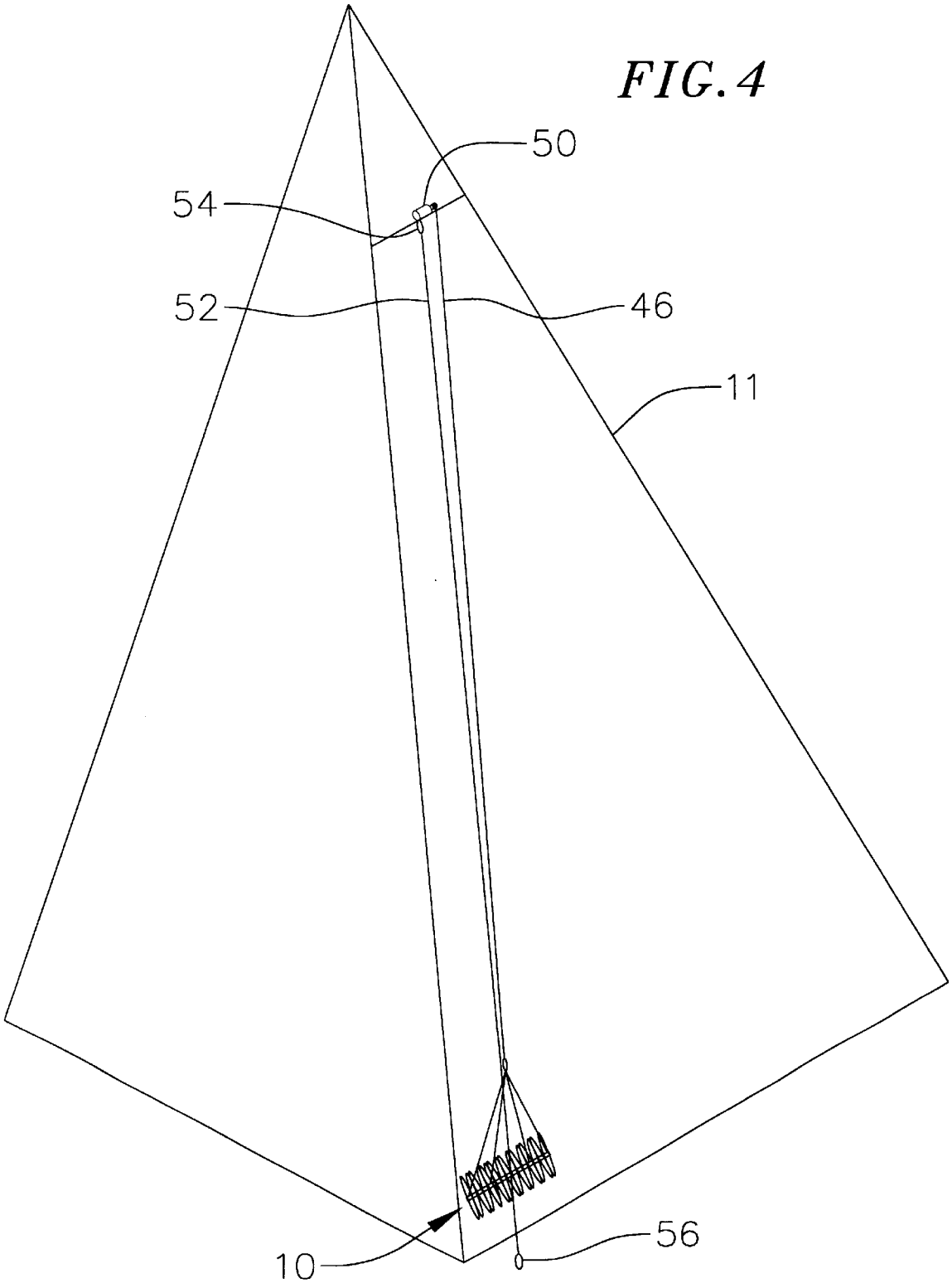
FIG. 4 is a perspective view of the cleaner of FIG. 1 in use on an inclined planar surface.

The present invention also includes a towing means for pulling the cleaner 10 in the forward and reverse directions. With reference to FIG. 4, the preferred embodiment includes a number of support lines 44 are connected to the eyelets 18. The support lines 44, in turn, are connected to a tow line 46 via a connector 48. The connector 48 could be a ring, a hook, or the like. The tow line 46 is attached to a winch 50. The winch 50 may be hand-cranked or, preferably, powered by a motor, engine, or the like. The winch 50 allows an operator to draw in the tow line 46 to thereby pull the cleaner 10 in a forward direction, or pay out the tow line 46 to thereby lower the cleaner 10 in a reverse direction.

Guiding means are also provided to define the path of the cleaner 10 and guide the cleaner 10 as it moves in a forward or reverse direction. In the preferred embodiment, the guiding means includes a guide line 52 which is anchored near the top 54 and bottom 56 of the surface 11. A cable tracker 58, comprising a pair of adjacent pulleys 60, is disposed on the boom 12. Preferably the cable tracker 58 is disposed near the longitudinal center of the boom 12. The guide line 52 is threaded between the pulleys 60 which thereby retain the guide line 52.

In operation, according to the method of the present invention, the cleaner 10 described above is thoroughly wetted with water. Preferably, deionized water is used. Regardless of the type of water used, the mops 36 must be thoroughly rinsed to remove any residual dirt or dust on the mops 36.

The guiding means is used to define a path to be cleaned along the surface 11. In the preferred embodiment, the operator threads the guide line 52 through the cable tracker 58 on the boom 12. The operator then fixes one end of the guide line 52 at the top 54 of the surface 11 and the other end of the guide line 52 at the bottom 56 of the surface 11 such that the guide line 52 lies along the path to be cleaned. By anchoring both ends of the guide line 52, the operator can define a path with any angle that the shape of the surface 11 may require. For example, to clean a substantially pyramidal building would require that the cleaner 10 move along a path angled with respect to a vertical line.

As the winch 50 is activated, the boom 12 is drawn forward across the surface 11 along the path defined by the guide line 52. The skis 20 and mops 36 are held in contact with the surface 11 by the weight of the boom 12. The forward edge of the mops 36 clean the surface 11 of dirt and debris as the boom 12 is drawn forward.

When the boom 12 reaches the top 54 of the surface 11, the direction of the winch 50 is reverse and line is paid out. The boom 12 traverses the same path along the surface 11 in the reverse direction with the reverse edges of the mops 36 leading. Thus, the surface 11 is wiped using a clean edge of the mops 36. This prevents streaking and smearing.

Upon reaching the bottom 56 of the surface 11, the mops 36 are once again thoroughly rinsed with water, preferably de-ionized water. A new path is defined and the steps of the process are repeated.

An advantage of the present invention is that the cleaner 10 is unmanned and, thus, is safer for workers than manually cleaning the surface 11. Another advantage of the invention is that the skis 20 allow the cleaner 10 to glide over obstructions and imperfections in the surface 11 without snagging while still maintaining contact with the surface 11 to insure proper cleaning. Yet another advantage of the invention is that it can clean a large surface area quickly. Another advantage of the invention is that it can be used to clean inclined or declined surfaces as well as vertical surfaces. Moreover, the cleaner 10 can move in any angular direction by following the guide line 52. A further advantage of the present invention is that the cleaner 10 neither connects to a water supply nor carries water reservoirs.

I claim:

1. A device for cleaning substantially planar surfaces, comprising:

a boom;

a guide structure pivotally connected to said boom to guide the boom in both a forward and a reverse direction along the surface;

a plurality of mops covering said guide structure, said mops in contact with the surface;

means for towing said boom in the forward and reverse directions along the surface, said towing means connected to said boom; and means for guiding the path of said boom, said guiding means connected to said boom.

2. The cleaner of claim 1 wherein said guide structure comprises a plurality of skis in a sawtooth arrangement along said boom.

3. The cleaner of claim 1 wherein said towing means comprises:

a plurality of support lines connected to said boom;

a tow line connected to said support lines; and a winch connected to said tow line for winding and unwinding said tow line.

4. The cleaner of claim 1 wherein said guiding means comprises:

a pair of pulleys disposed on said boom; and a guide line retained between said pulleys, said guide line anchored at the top and bottom of said surface to define the path of said cleaner.

5. A device for cleaning a substantially planar surface, comprising:

a boom;

a plurality of skis pivotally connected to said boom to guide the boom in both a forward and a reverse direction along the surface, said skis in a sawtooth arrangement across said boom;

a plurality of mops covering said skis, said mops in contact with the surface;

a plurality of support lines connected to said boom;

a tow line connected to said support lines; and a winch connected to said tow line for winding and unwinding said tow line;

a pair of pulleys disposed on said boom; and a guide line retained between said pulleys, said guide line anchored at the top and bottom of said surface to define the path of said cleaner.

6. The cleaner of claim 5 wherein said pairs of skis connected at their back ends define a fifteen degree angle with respect to one another.

* * * * *